United States Patent [19]

Larson et al.

[11] 4,039,047

[45] Aug. 2, 1977

[54] LADDERS INCORPORATING RETRACTABLE GROUND SPIKES

[75] Inventors: Clayton E. Larson, Brooklyn, N.Y.; Earl T. Records, Warsaw, Ind.

[73] Assignee: White Metal Rolling & Stamping Corporation, Brooklyn, N.Y.

[21] Appl. No.: 690,175

[22] Filed: May 26, 1976

[51] Int. Cl.[2] ..... E06C 7/46

[52] U.S. Cl. ..... 182/111

[58] Field of Search ..... 182/109, 111, 108, 107

[56] References Cited

U.S. PATENT DOCUMENTS

| | | | |
|---|---|---|---|
| 1,113,446 | 10/1914 | Kline | 182/111 |
| 1,352,323 | 9/1920 | Stephan | 182/109 |

*Primary Examiner*—Reinaldo P. Machado

*Attorney, Agent, or Firm*—Carroll F. Palmer

[57] ABSTRACT

The safety of ladders is improved by providing them with pivoted foot members that carry ground spikes that rest against the foot member when not in use and rotate for ground penetration into a position in which the foot member exerts leverage to dig the spikes into the ground.

4 Claims, 6 Drawing Figures

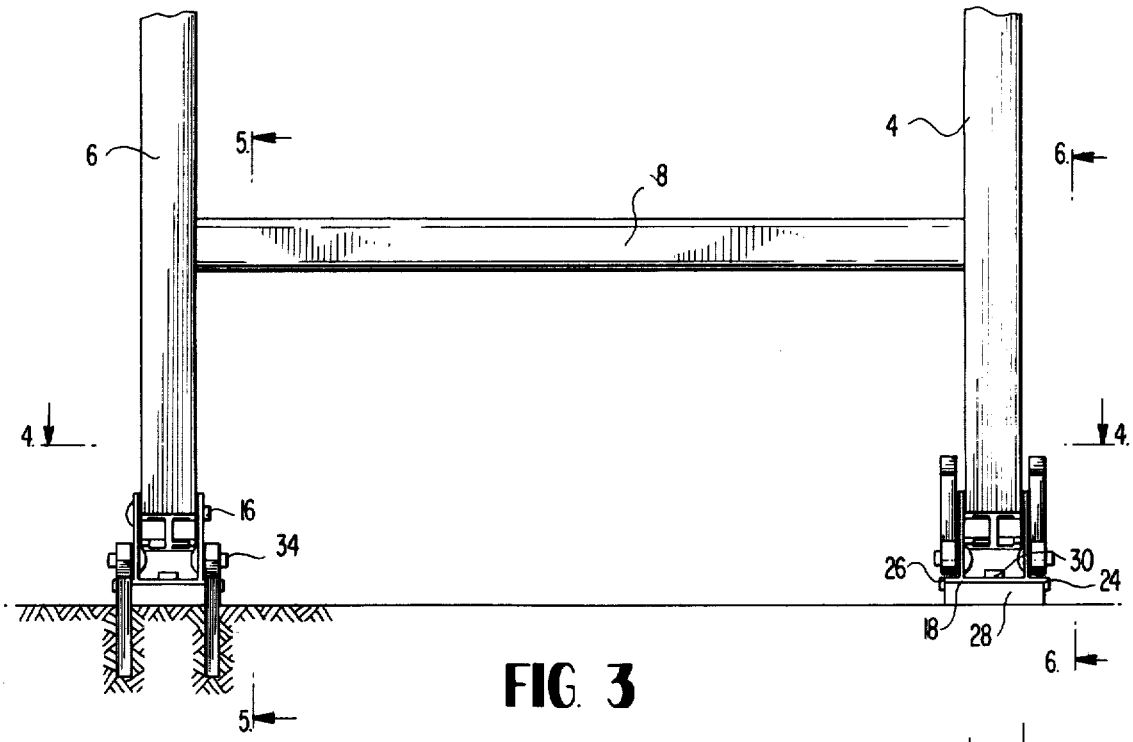
FIG. 3
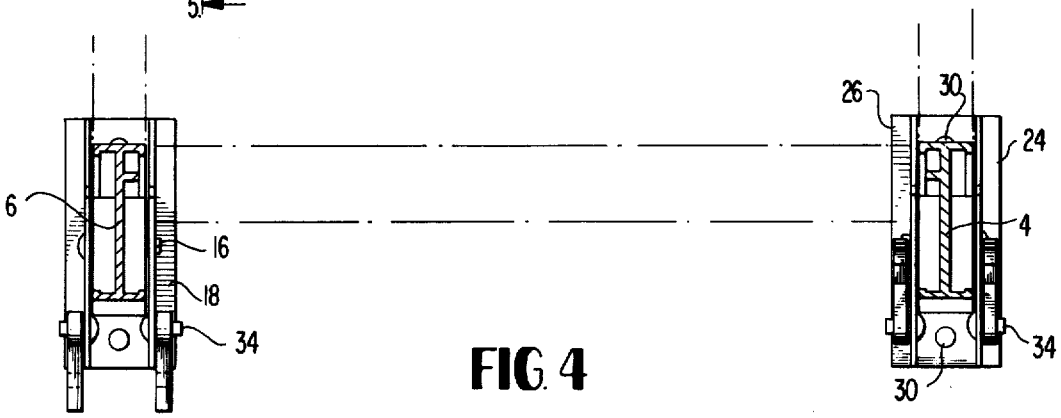
FIG. 4
FIG. 5
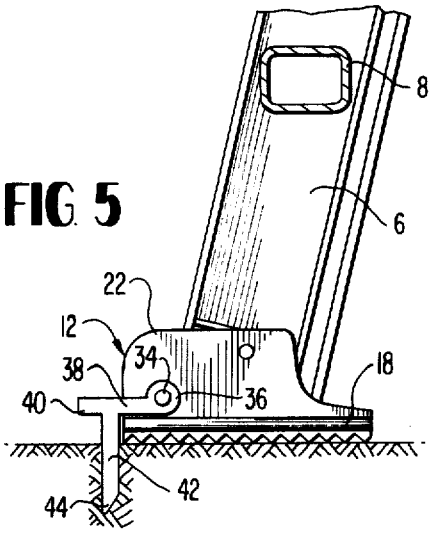
FIG. 6
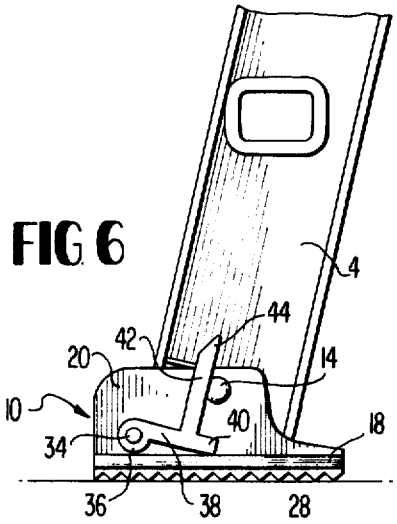

LADDERS INCORPORATING RETRACTABLE GROUND SPIKES

BACKGROUND OF THE INVENTION

1. Field of the Invention

This invention relates to ladders. More particularly it concerns retractable ground spikes that may be used to inhibit sliding of the base of the ladder when positioned on grass, dirt, clay or other troublesome ground condition.

2. Description of the Prior Art

Although ladders are not rated high on the Consumer Product Safety Commission's list of hazardous products, there is a need to improve upon their design and construction to diminish risk of injury to their users. With ladders of the type that prop against a building or similar structure during use, the base of the ladder may slip outwardly away from the building as a user ascends the ladder. If the ladder base rests on grass, dirt, clay or other slippery surface, this slippage tendency can present a serious safety hazard to the user.

It is known to provide ladders with spikes or cleats which can serve to reduce the ladder slippage problem. Patents which serve to show the state of development of the art include: U.S. Pat. Nos. 625,066, 936,219, 1,243,844, 1,352,323, 1,496,201, 1,909,565, 2,021,017, 2,127,035.

In spite of the numerous improvements in this field as indicated by the listed patents, there is a need for further advance in this art. For example, there is a need for safety ground spikes that form an integral part of the ladder, that can be moved to a protected storage position when not needed and that can be quickly and easily moved to a ground spiking position when required by the ground support conditions.

OBJECTS

A principal object of this invention is the provision of new forms of retractable ground spikes for ladders. Further objects include:

1. The provision of ladder ground spikes that may nest in a protected position when not in use.
2. The provision of such spikes that when rotated into the position for use will be leveraged so that the spikes tend to dig more deeply into the ground or other support surface.
3. The provision of ladder ground spikes of such shape and arrangement that it is possible to have dual spikes at each side of a ladder thereby providing greater safety and efficiency and less possibility of user injury.
4. The provision of such spikes that are compact, durable and strong.
5. The provision of such spikes having a shape that provides an area to which the foot of a user may be applied to force the spikes into the ground, when the ladder use requires use of the ground spikes.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

These objects are accomplished according to the present invention by providing ladders with foot members that are pivoted upon the lower ends of the ladder side rails and pivotally mounting T-shaped spikes on the sides of the foot members so the spikes may move from a storage position protected by the foot member structure to an operative position wherein the leg of the T depends below the foot member.

Advantageously, each foot member carries a pair of T-shaped spikes, one on one side and the other on the opposite side.

The retractable ground spikes may be used with single section ladders, but are particulary useful with multisection extension ladders that usually present increased safety hazard because of their greater potential length and climbing height.

BRIEF DESCRIPTION OF THE DRAWINGS

A more complete understanding of the invention can be had by reference to the accompanying drawings in which:

FIG. 3 is a fragmentary front vertical view of the ladder of FIG. 1.

FIG. 4 is a sectional view taken on the line 4—4 of FIG. 3.

FIG. 5 is a fragmentary sectional view taken on the line 5—5 of FIG. 3.

FIG. 6 is a fragmentary sectional view taken on the line 6—6 of FIG. 3.

DESCRIPTION OF THE PREFERRED EMBODIMENTS

Figure 1:
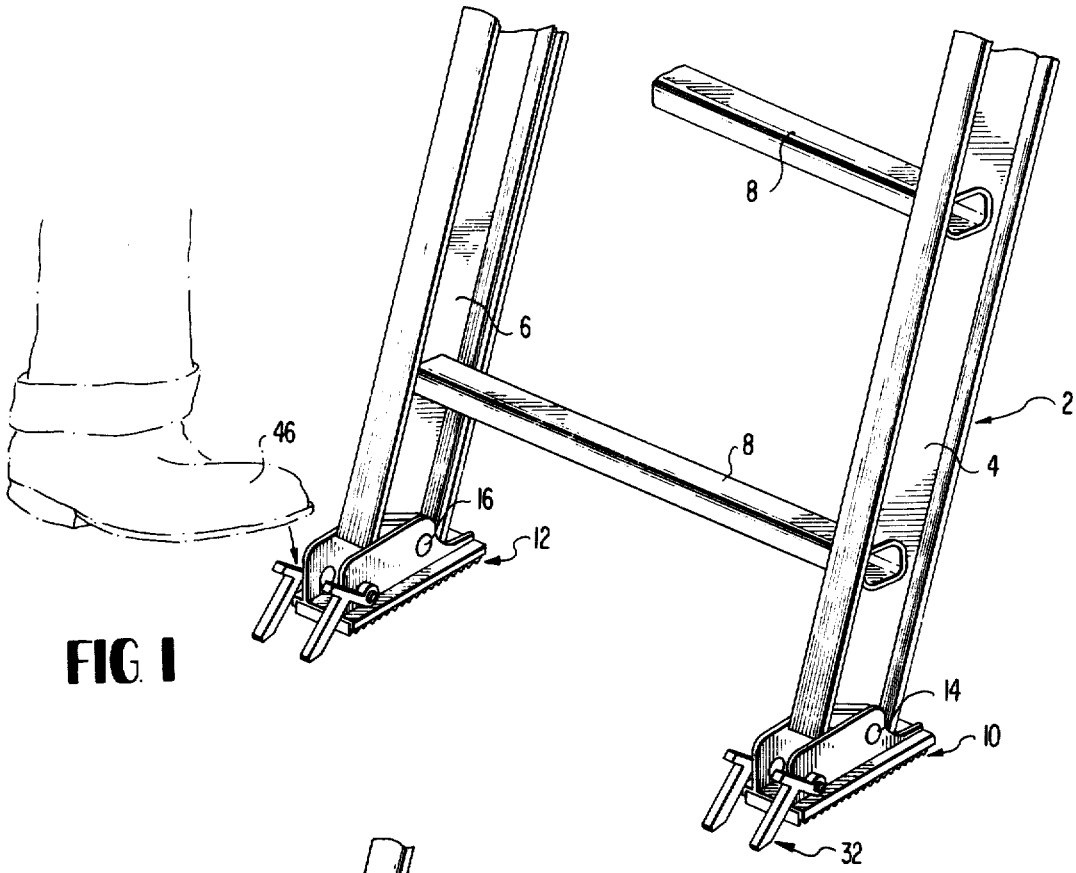
FIG. 1 is a fragmentary perspective view of a ladder equipped with retractable ground spikes of the invention.

Referring in detail to the drawings, the ladder 2 comprises a pair of side rails 4 and 6 and a plurality of steps or rungs 8 fixed at spaced intervals between the side rails.

Foot members 10 and 12 are pivoted upon the side rails 4 and 6 respectively by pins 14 and 16. Each foot member comprises a transverse web 18 and a pair of flanges 20 and 22 fixed normally to said web 18 spaced apart slightly more than the width of the side rails. The webs 18 are wider than the distance between the outside faces of the flanges 20 and 22, thereby providing ledge portions, 24 and 26 at each side of a foot member. Resilient pads 28 are fixed by rivets 30 to the bottom surface of the webs 18.

T-shaped spike members 32 are pivotally carried on the sides of the foot members 10 and 12 on pins 34. The pivot bearings 36 for each spike member 32 is at the one end of the top 38 of the T and the other end 40 of the T-top 38 is unattached. The leg 42 of the T has its free-end 44 pointed.

As seen in FIG. 6, when the spike members 32 are in the storage position, the free-end 40 of the T-top 38 rests upon the respective ledge portion 24 or 26 of the foot member 10.

As seen in FIG. 5, when the spike members 32 are in the operative position, the T-legs 42 depend below the respective foot member 12 and the pivoted side of the T-top 38 engages the respective ledge portion 24 or 26.

The shape of the spike members 32 when they are moved toward the operative position (see FIG. 1) provides an area for applying a foot 46 of a user to force the spike legs 42 into the ground. The square shape and compactness of the spike members 32 provides durability and strength.

The positioning and rotary action of the spike members 32 allow for nesting in a protected position against the safety feet when in the storage position as shown in FIG. 6.

Figure 2:
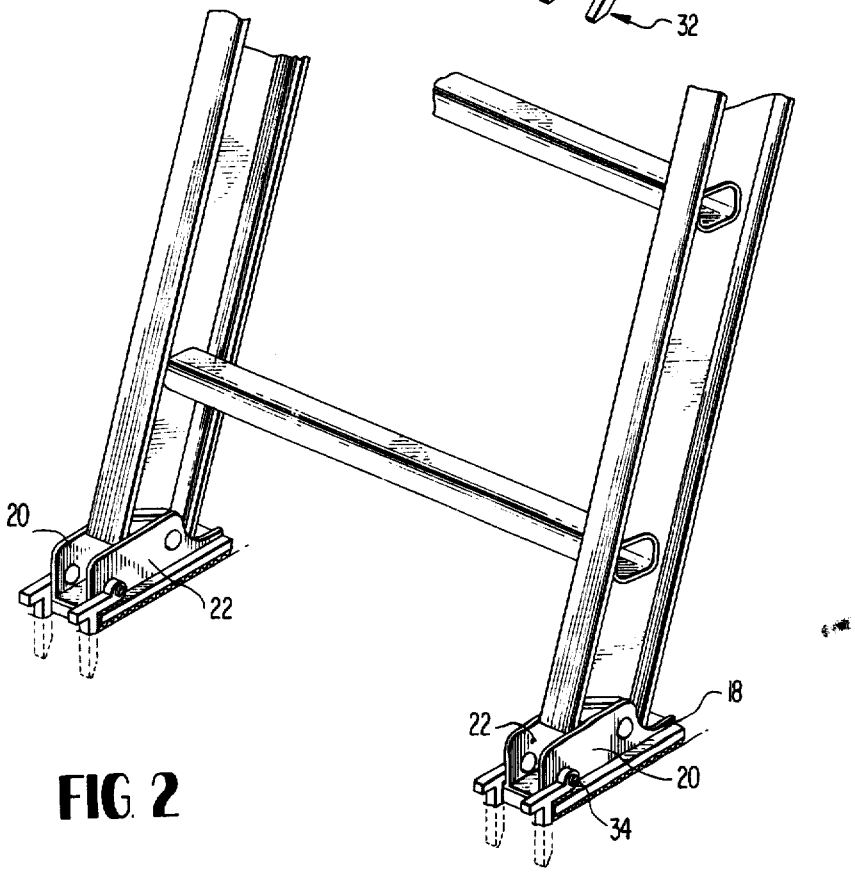
FIG. 2 is similar to FIG. 1, but shows the spikes implanted in the ground.

When the spike members 32 are in the operative position, as shown in FIGS. 2 and 5 for example, a considerable leverage is exerted upon the spike legs 42 which tends because of a horizontal force vector from the pivoted feet 10 and 12, to dig the spike members more deeply into the ground.

The positioning and shape of the spike members 32 makes it possible for each foot member 10 and 12 to carry a pair of spike members to provide maximum safety and efficiency. In order to reduce costs in making and selling the ladders, however, it is possible to provide each foot member with only one spike, either on the inside or outside.

The foot members and spikes of the invention may be made of any suitable material, e.g., ferrous metal, plastic, etc. Light metal alloys, e.g., aluminum or magnesium, are now extensively used in the construction of metal ladders and, advantageously, the foot members and spikes can be machined out of extrusions of such metal alloys.

The embodiments of the invention in which an exclusive property or privilege is claimed are defined as follows:

1. In a ladder comprising a pair of side rails and a plurality of steps or rungs fixed at spaced intervals between said side rails, the improvement for improving safety in use of the ladder which comprises:

a foot member pivoted upon the lower end of each side rail of the ladder, said foot members comprising a transverse web and a pair of flanges fixed normally to said web spaced apart at least the width of said side rails, said web having a width greater that the distance between said flanges providing a ledge portion at each side of the foot member, and a T-shaped spike member carried on one side of each foot member, the pivot bearing for each spike member being at one end of the top of T whereby the spike member moves from a storage position, wherein the free-end of said top rests upon a respective ledge portion, to an operative position wherein the leg of the T depends below the foot member with the pivoted side of the top of the T engaging said ledge portion, the pivot bearing for each spike member being journaled rearwardly of the front edge of its respective foot member a distance such that when the spike member is in said operative position the rear edge of the leg of the T substantially abuts said front edge of the foot member.

2. The ladder of claim 1 wherein each foot member carries two of said spike members, one on one side of said member and the other on the opposite side of said member.

3. The ladder of claim 1 wherein the free-end of the leg of the T of each spike member is pointed.

4. The ladder of claim 1 wherein the foot members are padded.

* * * * *